United States Patent [19]

Colvard

[11] Patent Number: 4,748,749

[45] Date of Patent: Jun. 7, 1988

[54] WALKING BOOT/SKI GAITER COMBINATION PARTICULARLY USEFUL FOR DOWNHILL SKIING

[76] Inventor: Michael Colvard, 14624 Sherman Way, Suite 508, Van Nuys, Calif. 91405

[21] Appl. No.: 930,766

[22] Filed: Nov. 14, 1986

[51] Int. Cl.[4] ..... A41D 17/00; A43B 3/00; A43B 5/04

[52] U.S. Cl. ..... 36/2 R; 36/4; 36/10; 36/117; 36/119

[58] Field of Search ..... 36/2 R, 1.5, 4, 10, 36/117, 119; 2/239

[56] References Cited

U.S. PATENT DOCUMENTS

| | | | |
|---|---|---|---|
| 3,618,232 | 11/1971 | Shnuriwsky | 36/1.5 |
| 3,691,658 | 9/1972 | Di Perno | 36/4 |
| 4,154,009 | 5/1979 | Kubelka et al. | 36/119 |
| 4,268,931 | 5/1981 | Salomon | 36/10 X |
| 4,302,889 | 12/1981 | Negrin | 36/4 |

FOREIGN PATENT DOCUMENTS

| | | | |
|---|---|---|---|
| 1041295 | 10/1978 | Canada | 36/4 |
| 70430 | 5/1945 | Norway | 36/10 |
| 304988 | 1/1929 | United Kingdom | 36/4 |
| 343224 | 2/1931 | United Kingdom | 36/4 |

*Primary Examiner*—James Kee Chi
*Attorney, Agent, or Firm*—Charles H. Schwartz; Ellsworth R. Roston

[57] ABSTRACT

The present invention provides an improved retractable walking over-boot/ski gaiter combination which is particularly useful for ski lodgewear and for downhill skiing. In one embodied form the unique combination comprises a soft detachable elastic inner sock which is secured to a flexible retractable over-boot having a gaiter top portion. The juncture between a top portion of the inner sock and over-boot is contoured to wrap tightly around a wearer's leg in the region between the ankle and knee. Preferably, the inner sock is fabricated from an elastic woven or knitted material and the over-boot is fabricated from a relatively soft, water repellent material such as polyurethane. In a distended position, the over-boot provides flexible and comfortable footgear for the skier for indoor and outdoor walking prior to reaching the desired terrain for skiing. Upon arrival at the selected skiing site, the wearer retracts the flexible over-boot by an anterior fastener, and positions the over-boot to surmount the top of a conventional rigid ski boot. Once retracted, the novel over-boot may be secured to the conventional ski boot which provides good leg insulation and provides a snow shield surrounding the top portion of the ski boot.

10 Claims, 1 Drawing Sheet

WALKING BOOT/SKI GAITER COMBINATION PARTICULARLY USEFUL FOR DOWNHILL SKIING

BACKGROUND OF THE INVENTION

This invention relates to foot gear which has a particular use for downhill skiers.

Downhill skiers generally arrive at ski lodges wearing street shoes or conventional foot gear designed for customary walking. Typically, upon arrival at the ski slope such foot gear is removed by the skier and checked at the ski lodge.

At the lodge, conventional ski boots having an outer relatively rigid upper and sole, are worn by the skier who walks clumsily through the ski lodge and across the snow toward the ski lift area, or other terrain to be skied.

Once the skier has reached the desired locale, the wearer then fastens the conventional ski boots to the skis, generally by the use of associated specialized bindings.

It has been long been known in downhill and cross country skiing, winter mountaineering and similar outdoor situations to wear gaiters to protect the skier's feet and lower legs against penetration of snow or other moisture. Such gaiters are typically made of fabric that is wrapped around the lower leg or boot or shoe top, and secured with releasable fasteners. Hooks on the bottom of such gaiters engage boot or shoe laces to hold such gaiters in place at their bottom. However, with such gaiter designs, significant snow or other moisture penetration may occur around the bottom of the gaiters.

Various boot and gaiter designs have been developed for the skiing environment.

One such boot for in-lodge wear is disclosed in Negrin, U.S. Pat. No. 4,302,889 issued on Dec. 1, 1981. Negrin discloses a boot suitable for after skiing which comprises in one embodied form a sole portion, and an exterior vamp portion connected to the sole portion. The exterior vamp portion is connected at the top to form a turned-over portion and an interior layer continuous with the turned-over vamp portion is fabricated to provide a chamber between the exterior portion and interior layer. The chamber is stated as being closed and inaccessible to the exterior environment. The Negrin footwear may be worn after skiing and either be knee high or ankle high type.

U.S. Pat. No. 4,095,355 issued to Annovi on Jun. 20, 1986, describes a ski boot with aerated padding of differing degrees of softness. In one embodied form, the boot is constructed with an outer rigid upper and soft insole possessing the variable softness features in different areas of the skier's foot. The surface of the soft insole in contact with the inner surface of the upper and/or the skier's foot comprises a plurality of projections having their tips in contact with the inner surface of the rigid and/or skier's foot. The spatial distribution of the projections over the contact area is stated to serve the varying degrees of softness of the insole without the need for varying the density of the material.

Baptista et al in U.S. Pat. No. 4,542,597 issued Sept. 24, 1985 describes a snow shield foot and leg insulator. In one embodied form, the Baptista apparel consists of an inner cloth tube for engagement with a foot and a leg and an outer cloth tube that has its top edge attached to the top edge inner cloth tube forming a seam, and a top sleeve for securing the seam, the leg and a bottom sleeve for securing the bottom edge of the outer cloth tube over the top portion of the boot to prevent snow from seeping into the top portion of the boot.

Diegelman in U.S. Pat. No. 4,461,098 issued July 24, 1984, describes a gaiter with improved moisture penetration protection. As embodied in one form the gaiter includes an upper fabric portion configured to be wrapped around a leg of a wearer. The upper fabric portion includes a releasable means for fastening the fabric portion around the leg. The upper fabric portion has a lower edge. The flexible water-impervious gasket configured to conform closely to a shoe worn by the wearer has an upper rim. A gasket is fastened to the thick fabric portion by means of a seam around the lower edge of the fabric portion. The lower edge of the fabric portion is folded up to lie against the rim of the gasket. The seam fastens the folded up lower edge against the lower rim of the gasket.

Other known foot gear is disclosed in U.S. Pat. Nos. 1,596,814; 4,516,336; 2,901,840; 1,651,634; 4,034,580; 4,204,345; French Pat. Nos. 208343 and U.S. Pat. Nos. 2,457,645; 3,044,188; 2,703,937; 3,264,761 and 3,410,004.

Each of the foregoing patents are related to specialized boot structures, inner socks and gaiters. Each of these foregoing disclosures is specifically incorporated herein by this reference.

While addressing the specialized environment of skiing terrain, and particular components for the environment, the foregoing known foot gear does not lend itself to multi-purpose function. Specifically, those skilled in the art have recognized a significant need for convenient multi-purpose foot gear which provides flexible and comfortable foot gear for the skier for indoor and outdoor walking prior to reaching the desired terrain for skiing, and affords the wearer good leg insulation and snow shield upon arrival at the selected skiing site. The present invention fulfills these needs.

SUMMARY OF THE INVENTION

The present invention provides an improved retractable walking over-boot/ski gaiter combination which is particularly useful for skilodge wear and for downhill skiing.

In one embodied form, the unique combination comprises a soft detachable elastic inner sock which is secured to a soft, flexible over-boot retractable between walking and skiing positions. The juncture between the inner sock and the over-boot is contoured to fit tightly around the wearer's leg in the region between the ankle and the knee.

Preferably, the elastic inner sock is woven or knitted and comprises a foot encasing portion and a leg encasing portion. The flexible over-boot comprises a gaiter top and is preferably fabricated from a relatively soft, water repellent material, for instance, polyurethane or similar polymeric material.

In a distended position, the retractable over-boot completely encases the inner sock in water-tight fashion and provides a flexible and comfortable foot gear for the skier for indoor wear and outdoor walking wear prior to reaching the selected skiing terrain. Upon arrival, at the terrain chosen for skiing, the over-boot is retracted by the wearer's release of an anterior fastening means, such as snap fasteners, Velcro or the like, which allows the lower portion of the over-boot to be conveniently retracted by the skier and drawn up over the top portion of a conventional rigid ski boot. In a retracted position, the novel over-boot with gaiter top portion provides good leg insulation against the cold, and acts as a snow shield surrounding the top portion of a conventional ski boot to prevent snow and moisture from entering the inside of the ski boot. Optionally, the lower portion of the over-boot may be secured by suitable fastener means to the ski boot laces or other top portion of the ski boot.

Accordingly, the inventive foot gear of the present invention provides comfortable, flexible indoor wear for the skier. Once at the selected skiing site, the wearer may open and slide the soft over-boot material above the ankle, and step into the conventional rigid ski boot. Moreover, the flexible material and gaiter top of the over-boot surmounts the top of the conventional ski boot to serve as a snow gaiter preventing snow and moisture from entering the top of the ski boot, and further providing good leg insulation.

In a presently preferred embodiment, the unique over-boot/ski gaiter combination is constructed in two layers. The inner sock is contoured to fit tightly around the leg between the ankle and knee, and can be detached, for instance by Velcro, zipper or other joinder means from the water repellent over-boot to allow the inner sock to be conveniently washed when soiled.

The above and other objects of the invention will become more readily apparent from review of the detailed description of the invention together with reference to the accompanying drawings and claims.

DETAILED DESCRIPTION OF THE PREFERRED EMBODIMENTS

The present invention provides an improved retractable walking over-boot/ski gaiter combination which is particularly useful for ski lodge wear and downhill skiing.

Figure 1:
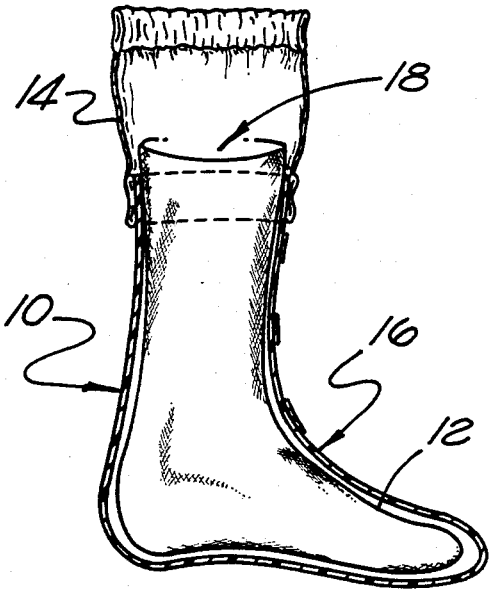
FIG. 1 is a side elevational view, in cross-section, illustrating the inventive combination in one embodied form, depicting an inner sock positioned within a retractable, flexible over-boot comprising a gaiter top to be worn, for instance, by a downhill skier.

One embodied form, the unique combination, generally denoted 10, illustrated in FIG. 1, comprises a soft detachable elastic inner sock 12 having a gaiter top portion 14 which is secured to a flexible retractable over-boot 16.

The juncture 18 between the top portion of the inner sock 12 and the over-boot 16 is contoured to wrap tightly around a wearer's leg in the region between the ankle and the knee.

Preferably, the inner sock 12 is fabricated from an elastic woven or knitted material. Suitable methods of knitting and yarn types are disclosed in U.S. Pat. No. 4,034,580 issued to Holder on July 12, 1977. However, those skilled in the art will readily appreciate a multitude of suitable fabrics and materials for construction.

Preferably, the over-boot 16 is fabricated from a relatively soft, water repellent material such as polyurethane film or similar polymers. This thickness of the over-boot wall should provide good flexibility and strength for walking comfortably, but also allow the over-boot to be conveniently retracted at the desired ski site.

Figure 2:
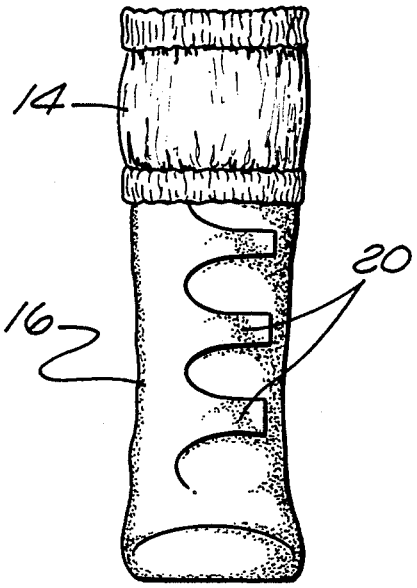
FIG. 2 is a front elevational view of the novel over-boot comprising the gaiter top depicted in FIG. 1 in a distended position for indoor and walking wear.

In a distended position shown in FIG. 2 the over-boot 16 provides flexible and comfortable foot wear for the skier for indoor and outdoor walking prior to reaching the desired terrain for skiing.

Figure 3:
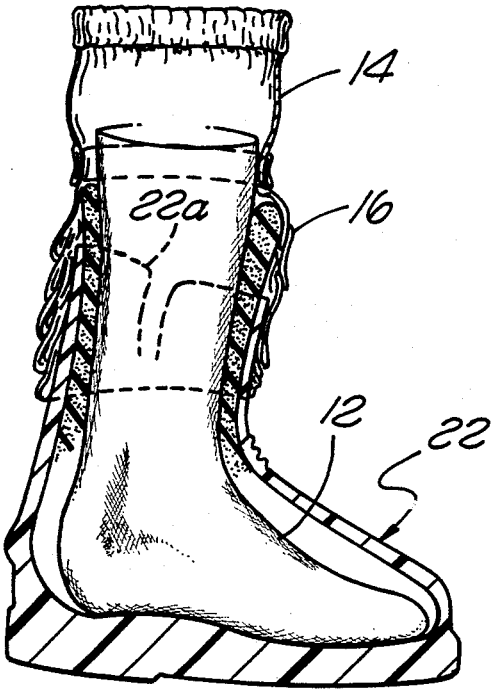
FIG. 3 is a side cross-sectional view of the inner sock, over-boot combination in a retracted position, surmounting a conventional ski boot to act as a snow shield and leg insulator.
Figure 4:
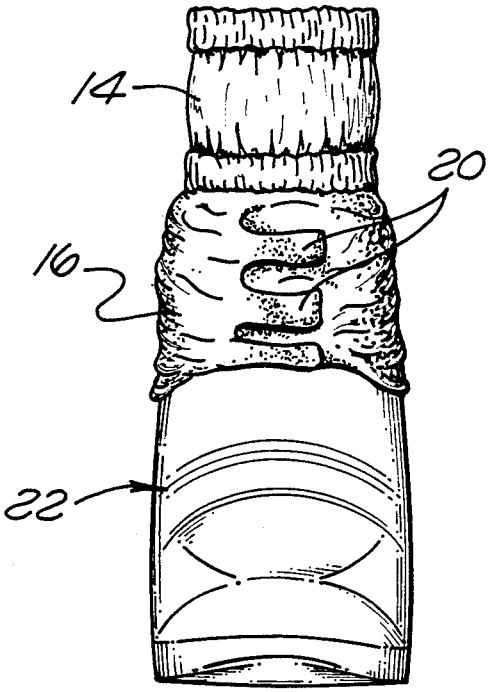
FIG. 4 is a front elevational view of the inventive over-boot comprising gaiter top, surmounting a conventional ski boot top portion in accordance with one embodiment of the present invention.

Referring to FIGS. 3 and 4, upon arrival at the selected site the wearer, opens, retracts the flexible over-boot 16 by an anterior fastener means 20 (FIG. 2), and positions the over-boot 16 to surmount the top **22*a* of a conventional rigid ski boot 22**.

Suitable fasteners for maintaining the over-boot 16 in a retracted condition with respect to the ski boot 22, include zippers, Velcro fasteners, buckles, tubular or circumferential materials and the like.

In a distended position, FIG. 2, the flexible overboot 16 will completely surround and encase the skier's foot (not shown). It is a particular feature of the invention, that the over-boot 16 comprises a gaiter top 14 to protect the skier's feet and lower legs against penetration of snow or other moisture. Fastening means such as that mentioned above, may suitably be positioned on the bottom portion of the over-boot 16, to secure the over-boot 16 in a retracted position to the top **22*a* of a conventional ski boot 22**.

Once retracted, as shown in FIGS. 3 and 4 and optionally secured to the conventional ski boot 22, the novel over-boot 16 provides good leg insulation and provides a snow shield surrounding the top portion of the conventional rigid ski boot 22.

Accordingly, upon arrival at the ski lodge, a skier employing the inventive foot wear will check street shoes or conventional foot gear designed for customary walking, at the ski lodge. Thereafter, the skier will insert his or her foot in the elastic inner sock 12 and insert the sock 12 within the novel over-boot 16 to be worn in a distended position. Alternatively, the skier may arrive at the ski recreational area or lodge wearing the inventive foot wear.

Once the skier has reached the selected skiing site, the wearer will retract the flexible over-boot 16 by an anterior fastener means 20 and position the over-boot 16 to surmount the top of the conventional rigid ski boot 22.

Accordingly, the present invention provides a novel multipurpose combination of walking boot and ski gaiter which is particularly useful for indoor ski lodge wear and downhill skiing.

No longer will the skier have to walk clumsily through the lodge and across the snow toward the ski lift in foot gear designed for skiing as opposed to walking.

The combination inventive walking boot/ski gaiter combination herein described will allow the skier to carry his ski boots to the lift, walking normally in footgear designed for walking.

Once he or she has reached the terrain suitable for skiing, the wearer will be able to open the overboot, slide the soft outer-boot material above the ankle and step into boots designed for skiing. The boot material will be brought over the ski boot and fastened to serve as snow-gaiter preventing snow and moisture from entering the top of the ski boot.

It is preferred that the inner sock be detachable from the over-boot to provide for convenient wearing when the sock is soiled. Suitable fastening means known to the art such as Velcro, snap fasteners, zippers or the like may be used to accomplish the temporary joinder of these two components.

Accordingly, it is not intended that this invention be limited in spirit and scope except as by the appended claims.

I claim:

1. A retractable walking over-boot/ski gaiter combination particularly useful for ski lodge wear and for use before and/or after skiing in combination with an inner sock having a foot encasing portion and a leg encasing portion extending upward from the foot encasing portion past the ankle, and a ski boot having a relatively rigid upper portion and a relatively rigid sole portion, comprising:

a flexible water repellent over-boot having a gaiter top portion, a foot encasing portion, a leg encasing portion and release means mounted on said over-boot for separating said over-boot to allow at least said boot encasing portion to be slid above the ankle;

said over-boot being adjustable by operation of said release means to a fully distended position and a fully retracted position; and wherein when said over-boot is disposed in the fully distended position said over-boot completely surrounds, in water-tight fashion, both the foot encasing and leg encasing portions of said inner sock and when said over-boot is disposed in the fully retracted position, at least said foot encasing portion of said over-boot is slid above the ankle and surmounts the upper portion of said ski boot, to provide good leg insulation and to provide a snow shield surrounding the top portion of the ski boot to prevent snow or other moisture from access to said inner sock.

2. The retractable walking over-boot/ski gaiter combination as described in claim 1 wherein said inner sock is composed of elastic fabric and is additionally part of said walking over-boot/ski gaiter combination.

3. The retractable walking over-boot/ski gaiter combination as described in claim 1 wherein said elastic fabric of said inner sock is knitted and is additionally part of said walking over-boot/ski gaiter combination.

4. The retractable walking over-boot/ski gaiter combination as described in claim 1 wherein said elastic fabric of said inner sock is woven and is additionally part of said walking over-boot/ski gaiter combination.

5. The retractable walking over-boot/ski gaiter combination as described in claim 1 wherein said soft elastic inner-sock is additionally detachably secured to an upper portion of said over-boot.

6. The retractable walking over-boot/ski gaiter combination as described in claim 1 wherein said soft elastic inner-sock is additionally detachably secured to said over-boot by fastener means.

7. The retractable walking over-boot/ski gaiter combination as described in claim 1 wherein said soft elastic inner sock is additionally detachably secured to said over-boot at a joinder area which is contoured to fit snuggly around the skier's leg.

8. The retractable walking over-boot/ski gaiter combination as described in claim 1 wherein said over-boot is composed of a flexible water repellent polymer.

9. The retractable walking over-boot/ski gaiter combination as described in claim 1 wherein said over-boot further comprises fastener means to attach said over-boot to said ski boot.

10. The retractable walking over-boot/ski gaiter combination as described in claim 1 wherein said release means is disposed in an anterior portion of said over-boot.

* * * * *